US006815402B2

(12) United States Patent
Tazaki et al.

(10) Patent No.: US 6,815,402 B2
(45) Date of Patent: Nov. 9, 2004

(54) LUBRICATING OIL COMPOSITION CONTAINING CYCLIC ORGANOPHOSPHORUS COMPOUND

(75) Inventors: Toshinori Tazaki, Chiba (JP); Hideto Kamimura, Chiba (JP); Shuichi Sakanoue, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 0 days.

(21) Appl. No.: 10/168,550

(22) PCT Filed: Dec. 25, 2000

(86) PCT No.: PCT/JP00/09201

§ 371 (c)(1),
(2), (4) Date: Jun. 27, 2002

(87) PCT Pub. No.: WO01/48129

PCT Pub. Date: Jul. 5, 2001

(65) Prior Publication Data

US 2003/0125219 A1 Jul. 3, 2003

(30) Foreign Application Priority Data

Dec. 28, 1999 (JP) ..... 11-373188

(51) Int. Cl.[7] ..... C10M 137/12; C09K 5/00

(52) U.S. Cl. ..... 508/422; 508/433; 508/462; 508/465; 508/485; 508/487; 508/496; 508/579; 252/68

(58) Field of Search ..... 508/422

(56) References Cited

U.S. PATENT DOCUMENTS 3,702,878 A 11/1972 Saito
4,136,041 A * 1/1979 Lenack ..... 508/422
4,416,829 A * 11/1983 Lee et al. ..... 508/422
4,729,848 A * 3/1988 Yamaguchi et al. ..... 508/422
4,950,414 A * 8/1990 Wildersohn et al. ..... 508/422
5,624,983 A * 4/1997 Pastor et al. ..... 508/422

FOREIGN PATENT DOCUMENTS

| | | |
|---|---|---|
| DE | 198 47 137 | 4/2000 |
| EP | 0 612 839 | 8/1994 |
| JP | 49-45397 | 12/1974 |
| JP | 3-185621 | 8/1991 |
| JP | 7-53582 | 2/1995 |
| JP | 10-53787 | 2/1998 |
| JP | 10-053787 | 2/1998 |

OTHER PUBLICATIONS

Smalheer et al "Lubricant Additives", Section I–Chemistry of Additives, p. 1–11, 1967.*

Patent Abstracts of Japan, JP 10–053787, Feb. 24,1998.

Patent Abstracts of Japan, JP 07–053582, Feb. 28,1995.

Patent Abstracts of Japan, JP 03–185621, Aug. 13,1991.

* cited by examiner

*Primary Examiner*—Ellen M. McAvoy
(74) *Attorney, Agent, or Firm*—Oblon, Spivak, McClelland, Maier & Neustadt, P.C.

(57) ABSTRACT

A lubricating oil composition which comprises at least one compound selected from specific cyclic organic phosphorus compounds is disclosed.

The lubricating oil composition exhibits excellent extreme pressure property, seizure resistance and wear resistance and is advantageously used as bearing oil, gear oil, hydraulic oil and refrigerator oil.

14 Claims, 2 Drawing Sheets

LUBRICATING OIL COMPOSITION CONTAINING CYCLIC ORGANOPHOSPHORUS COMPOUND

TECHNICAL FIELD

The present invention relates to a lubricating oil composition and, more particularly, to a lubricating oil composition which is bearing oil, gear oil or hydraulic oil exhibiting excellent extreme pressure property, seizure resistance and wear resistance and to a refrigerator oil composition which is stable and exhibits excellent extreme pressure property, seizure resistance and wear resistance under various refrigerants.

BACKGROUND ART

The role expected to be played by lubricating oil is to make movements of frictional portions smooth. To play this role, extreme pressure agents, antiseizure agents and antiwear agents are added to a base oil of lubricating oil and the extreme pressure property, seizure resistance and wear resistance are improved.

Recently, as facilities such as apparatuses and machines are becoming smaller and exhibiting higher performance, lubricating portions are subjected to much higher loads and speeds. Therefore, a lubricating oil is required to exhibit much more improved properties such as much more improved extreme pressure property; seizure resistance and wear resistance.

Various types of refrigerants are used in compression-type refrigerators. For example, hydrofluorocarbons whose typical examples include 1,1,1,2-tetrafluoroethane (R-134a) and fluorocarbons are used to prevent the environmental pollution such as the ozonosphere destruction and carbon dioxide, ethers, ammonia and hydrocarbons are used to prevent global warming and to secure the safety of the human being. Therefore, it is required that lubricating oil for compression-type refrigerators exhibit more improved extreme pressure property, seizure resistance and wear resistance and remain stable under the special atmosphere of these refrigerants.

The present invention has been made under the above circumstances and has an object of providing a lubricating oil composition which exhibits excellent extreme pressure property, seizure resistance and wear resistance and is advantageously used as bearing oil, gear oil, hydraulic oil and refrigerator oil.

The present invention has another object of providing a refrigerator oil composition which is stable and exhibits excellent extreme pressure property, seizure resistance and wear resistance under various refrigerants used for refrigerators.

DISCLOSURE OF THE INVENTION

As the result of extensive studies by the present inventors, it was found that the above object could be effectively achieved by using a lubricating oil composition comprising a specific cyclic organic phosphorus compound. The present invention has been completed based on the above knowledge. The present invention can be summarized as follows:

(1) A lubricating oil composition which comprises a base oil and at least one compound selected from cyclic organic phosphorus compounds represented by following general formula (I):

(I)

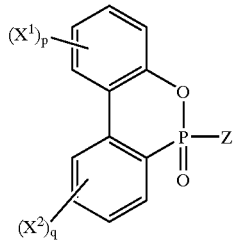

wherein Z represents hydrogen atom, an alkyl group, a cycloalkyl group which may be substituted with at least one of alkyl groups having 1 to 12 carbon atoms and hydroxyl group, an aryl group which may be substituted with at least one of alkyl groups having 1 to 12 carbon atoms and hydroxyl group or an alkyl group substituted with an aryl group which may be substituted with at least one of alkyl groups having 1 to 12 carbon atoms and hydroxyl group, $X^1$ and $X^2$ each independently represent a halogen atom or hydroxyl group and p and q each represent an integer of 0 to 3.

(2) A lubricating oil composition described in (1), wherein the cyclic organic phosphorus compound is a compound expressed by following formula (II):

(II)

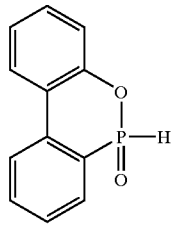

a compound expressed by following formula (III):

(III)

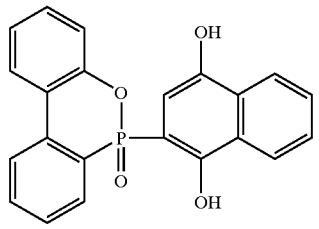

or a compound expressed by following formula (IV):

(IV)

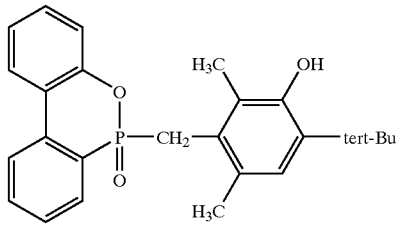

wherein tert-Bu represents tertiary-butyl group.

(3) A lubricating oil composition described in any one of (1) and (2), wherein a content of the cyclic organic phosphorus compound is 0.001 to 5% by weight based on an amount of the composition.

(4) A lubricating oil composition described in any one of (1) and (2), wherein the base oil is at least one oil selected from purified mineral oils, alkylbenzenes, poly-α-olefins, polyalkylene glycols, polyvinyl ethers, polyesters and polycarbonates.

(5) A lubricating oil composition described in any one of (1) to (4), which further comprises at least one agent selected from metal salts of carboxylic acids and phosphorus-based extreme pressure agents in an amount of 0.001 to 5% by weight based on an amount of the composition.

(6) A lubricating oil composition described in any one of (1) to (5), which further comprises phenolic antioxidants.

(7) A lubricating oil composition described in any one of (1) to (6), which further comprises acid scavengers.

(8) A lubricating oil composition described in any one of (1) to (7), which is bearing oil, gear oil or hydraulic oil.

(9) A lubricating oil composition described in any one of (1) to (7), which is refrigerator oil.

(10) A lubricating oil composition described in (9), wherein a refrigerator which uses the refrigerator oil is a compression-type refrigerator using a refrigerant containing fluorine, carbon dioxide, ammonia, an ether or a hydrocarbon as a refrigerant.

DESCRIPTION OF THE MARKS IN THE FIGURES

Figure 1:
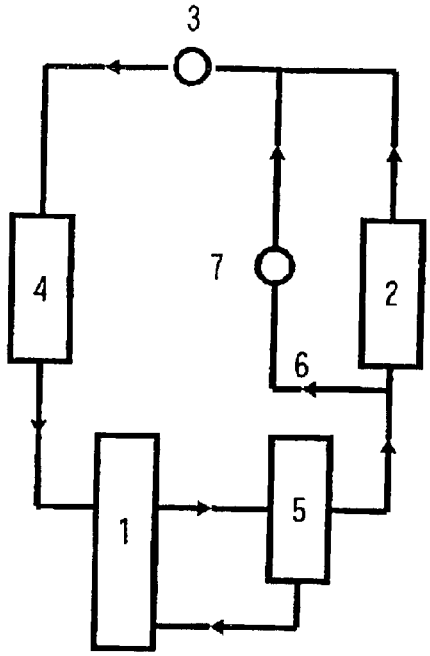
FIG. 1 shows a flow diagram which exhibits an example of the refrigerating cycle of the compression type of the "compressor-condenser-expansion valve-evaporator" system having an oil separator and a hot gas line.

| | |
|---|---|
| 1: | A compressor |
| 2: | A condenser |
| 3: | An expansion valve |
| 4: | An evaporator |
| 5: | An oil separator |
| 6: | A hot gas line |
| 7: | A valve for a hot gas line |

THE MOST PREFERRED EMBODIMENT TO CARRY OUT THE INVENTION

The cyclic organic phosphorus compound, the base oil and additives comprised where necessary which constitute the lubricating oil composition of the present invention will be described in the following.

1. Cyclic Organic Phosphorus Compound

The cyclic organic phosphorus compound used in the present invention is the compound represented by general formula (I) shown above.

The lubricating oil composition comprising the cyclic organic phosphorus compound in which phosphorus atom constitutes a portion of the ring exhibits remarkable improvements in the extreme pressure property, seizure resistance and wear resistance.

In the above general formula (I), Z represents hydrogen atom, an alkyl group, a cycloalkyl group which may be substituted with an alkyl group having 1 to 12 carbon atoms and/or hydroxyl group, an aryl group which may be substituted with an alkyl group having 1 to 12 carbon atoms and/or hydroxyl group or an alkyl group substituted with an aryl group which may be substituted with an alkyl group having 1 to 12 carbon atoms and/or hydroxyl group.

As the alkyl group described above, a linear or branched alkyl group having 1 to 20 carbon atoms is preferable and a linear or branched alkyl group having 1 to 12 carbon atoms is more preferable. The alkyl group may be an unsaturated alkyl group. When the number of carbon atoms in the alkyl group exceeds 20, the yield in the synthesis reaction is low and the preparation is difficult. Therefore, such a number of carbon atoms is not preferable from the standpoint of economy. As the cycloalkyl group, cyclopentyl group and cyclohexyl group are preferable from the standpoint of easiness of the production and economy. As the aryl group, phenyl group, naphthyl group and anthranyl group are preferable and phenyl group and naphthyl group are more preferable from the standpoint of easiness of the production and economy. Examples of the alkyl group substituted with an aryl group include alkyl groups having 1 to 3 carbon atoms which are substituted with phenyl group or naphthyl group. More preferable examples of the alkyl group substituted with an aryl group include benzyl group.

The cycloalkyl group, the aryl group and the alkyl group substituted with an aryl group described above may be substituted with an alkyl group and/or hydroxyl group. The alkyl group of the substituent is an alkyl group having 1 to 12 carbon atoms, preferably 1 to 8 carbon atoms and more preferably 1 to 6 carbon atoms. The alkyl group may be linear or branched. When the alkyl group has carbon atoms exceeding 12, the production of the compound is difficult and such a compound is not preferable from the standpoint of economy.

Specific examples of the alkyl group of the substituent include methyl group, ethyl group, n-propyl group, isopropyl group, n-butyl group, isobutyl group, tert-butyl group, n-amyl group, isoamyl group, tert-amyl group, n-hexyl group, isohexyl group, tert-hexyl group, tert-heptyl group and tert-octyl group.

A single or a plurality of the alkyl group and/or hydroxyl group may be present on the cycloalkyl group, the aryl group or the alkyl group substituted with an aryl group as the substituents. When a plurality of these groups are present, the plurality of groups may be the same with or different from each other. For example, when two alkyl groups are present, the two alkyl groups may be the same with or different from each other.

In general formula (I) representing the cyclic organic phosphorus compound, $X^1$ and $X^2$ each independently represent a halogen atom or hydroxyl group. Examples of the halogen atom include fluorine atom, chlorine atom, bromine atom and iodine atom. In general formula (I), p and q each represent an integer of 0 to 3. It is preferable that p and q both represent 0. Specific examples of the cyclic organic phosphorus compounds include the compounds represented by general formula (II), (III) or (IV).

The cyclic organic phosphorus compound represented by the above general formula (I) can be produced in accordance with a conventional process. For example, the compound represented by general formula (I) in which Z represents hydrogen atom, i.e., the compound represented by general formula (II), can be produced by reacting O-phenylphenol with phosphorus trichloride, followed by hydrolyzing the reaction product and dehydrating the obtained product by heating. The compounds represented by general formula (I) in which Z does not represent hydrogen atom but a group can be produced by using the compound represented by general formula (II) as the raw material and reacting this compound with a raw material for forming the group represented by Z. Specifically, the compound represented by general formula (III) can be produced by reacting the compound represented by general formula (II) with 1,4-naphthoquinone. The compound represented by general formula (IV) can be produced by reacting the compound represented by general formula (II) with the corresponding compound having chlorinated benzyl group.

In the present invention, the lubricating oil composition may comprise a single or a plurality of the cyclic organic phosphorus compounds. In the present invention, the lubricating oil composition comprises the cyclic organic phosphorus compound in an amount of 0.001 to 5% by weight, preferably 0.005 to 1% by weight and more preferably 0.01 to 0.5% by weight based on the amount of the lubricating oil composition. When the amount is less than 0.001% by weight, the effect is not exhibited sufficiently, occasionally. Even when the amount exceeds 5% by weight, the effect is not further enhanced, occasionally.

2. Base Oil

In the present invention, the base oil to which the cyclic organic phosphorus compound described above is added is not particularly limited. Any base oil can be used as long as the base oil has a viscosity as lubricating oil. It is preferable that the base oil has a kinematic viscosity at 40° C. of 2 to 600 $mm^2/s$ and more preferably 5 to 500 $mm^2/s$.

Among the base oils having the above kinematic viscosity, purified mineral oils, alkylbenzenes, poly-α-olefins, polyalkylene glycols, polyvinyl ethers, polyesters and polycarbonates exhibit the remarkable effect of improving the properties such as the extreme pressure property. These base oils will be described in the following.

2-1 Purified Mineral Oil

The purified mineral oil preferably used as the base oil in the present invention is a mineral oil having a total acid value of 0.1 mg KOH/g or smaller and preferably 0.05 mg KOH/g or smaller, a pour point of −10° C. or lower, preferably −15° C. or lower and more preferably −20° C. or lower and a sulfur content of 1% by weight or smaller, preferably 0.5% by weight or smaller and more preferably 0.1% by weight or smaller. Any of paraffinic mineral oils and naphthenic mineral oils can be effectively used.

The purified mineral oil is obtained, in general, by treating a lubricating oil fraction obtained from crude oil in accordance with a suitable combination of purification with solvents, decomposition by hydrogenation, purification by hydrogenation, dewaxing with solvents and dewaxing by hydrogenation. When the purified mineral oil is used as the base oil, a remarkable improvement in the extreme pressure property can be exhibited.

2-2 Alkylbenzene

Examples of the alkylbenzene preferably used as the base oil in the present invention include various alkylbenzenes conventionally used as lubricating oil. Any of hard alkylbenzenes (the branched type), soft alkylbenzenes (the linear type) and mixtures of these alkylbenzenes can be effectively used as long as the alkylbenzene has a suitable kinematic viscosity. When the alkylbenzene is used as the base oil, a remarkable improvement in the extreme pressure property can be exhibited.

2-3 Poly-α-Olefin

Examples of the poly-α-olefin preferably used as the base oil in the present invention include polymers of α-olefins having 8 to 16 carbon atoms which have a viscosity as lubricating oil. Among the polymers of α-olefins, polymers of 1-octene, 1-decene and 1-dodecene which have a kinematic viscosity at 40° C. of 2 to 600 $mm^2/s$ are preferable. When the poly-α-olefin is used as the base oil, a remarkable improvement in the extreme pressure property can be exhibited.

2-4 Polyoxyalkylene Glycol

Examples of the polyoxyalkylene glycol preferably used as the base oil in the present invention include compounds represented by general formula (V)

$$R^1—[(OR^2)_m—OR^3]_n \quad (V)$$

wherein $R^1$ represents hydrogen atom, an alkyl group having 1 to 10 carbon atoms, an acyl group having 2 to 10 carbon atoms or an aliphatic hydrocarbon group having 1 to 10 carbon atoms and 2 to 6 bonding portions; $R^2$ represents an alkylene group having 2 to 4 carbon atoms; $R^3$ represents hydrogen atom, an alkyl group having 1 to 10 carbon atoms or an acyl group having 2 to 10 carbon atoms; n represents an integer of 1 to 6; and m represent numbers giving an average value of numbers represented by m×n in a range of 6 to 80.

In the above general formula (I), the alkyl group having 1 to 10 carbon atoms which is represented by $R^1$ or $R^3$ may be any of linear, branched and cyclic alkyl groups. Examples of the alkyl group include methyl group, ethyl group, n-propyl group, isopropyl group, various types of butyl group, various types of pentyl group, various types of hexyl group, various types of heptyl group, various types of octyl group, various types of nonyl group, various types of decyl group, cyclopentyl group and cyclohexyl group. When the number of carbon atom in the alkyl group exceeds 10, miscibility with the refrigerant decreases and phase separation occasionally takes place. It is preferable that the number of carbon atom in the alkyl group is 1 to 6.

In the acyl group having 2 to 10 carbon atoms which is represented by any of $R^1$ and $R^3$, the portion of an alkyl group may be any of linear, branched and cyclic alkyl groups. Examples of the portion of an alkyl group in the acyl group include the alkyl groups having 1 to 9 carbon atoms among the groups described above as the examples of the alkyl group. When the number of carbon atom in the acyl group exceeds 10, miscibility with the refrigerant decreases and phase separation occasionally takes place. It is preferable that the number of carbon atom in the alkyl group is 2 to 6. When $R^1$ and $R^3$ each represent an alkyl group or an acyl group, $R^1$ and $R^3$ may represent the same group or different groups.

When n represents a number of 2 or greater, the atoms and the groups represented by the plurality of $R^3$ in one molecule may be the same with or different from each other.

When $R^1$ represents an aliphatic hydrocarbon group having 1 to 10 carbon atoms and 2 to 6 bonding portions, the aliphatic hydrocarbon group may be linear or cyclic. Examples of the aliphatic hydrocarbon having 2 bonding portions include ethylene group, propylene group, butylene group, pentylene group, hexylene group, heptylene group, octylene group, nonylene group, decylene group, cyclopentylene group and cyclohexylene group. Examples of the aliphatic hydrocarbon group having 3 to 6 bonding portions include groups obtained by removing hydroxyl groups from polyhydric alcohols such as trimethylolpropane, glycerol, pentaerythritol, sorbitol, 1,2,3-trihydroxycyclohexane and 1,3,5-trihydroxycyclohexane.

When the number of carbon atoms in the aliphatic hydrocarbon groups exceeds 10, miscibility with the refrigerant decreases and phase separation occasionally takes place. It is preferable that the number of carbon atom is 2 to 6.

In the present invention, it is preferable that at least one of $R^1$ and $R^3$ represents an alkyl group, more preferably an alkyl group having 1 to 3 carbon atoms and most preferably methyl group from the standpoint of the viscosity property. From the same standpoint, it is preferable that $R^1$ and $R^3$ each represent an alkyl group and more preferably methyl group.

In the above general formula (V), $R^2$ represents an alkylene group having 2 to 4 carbon atoms. Examples of the oxyalkylene group as the repeating unit include oxyethylene group, oxypropylene group and oxybutylene group. The oxyalkylene groups in one molecule may be the same with or different from each other and two or more types of oxyalkylene groups may be contained in one molecule. It is preferable that the oxyalkylene group is a copolymer comprising oxyethylene group (EO) and oxypropylene group (PO). From the standpoint of the load of seizure and the viscosity property, it is preferable that the value of EO/(PO+EO) is in the range of 0.1 to 0.8. From the standpoint of the hygroscopic property, it is preferable that the value of EO/(PO+EO) is in the range of 0.3 to 0.6.

In the above general formula (V), n represents an integer of 1 to 6 which is decided in accordance with the number of the bonding portion of the group represented by $R^1$. For example, n represents 1 when $R^1$ represents an alkyl group or an acyl group and 2,3,4,5 or 6 when $R^1$ represents an aliphatic hydrocarbon group having 2,3,4,5 or 6 bonding portions, respectively. m represent numbers giving an average value of numbers represented by m×n in the range of 6 to 80. When the average value of numbers represented by m×n is outside the above range, the object of the present invention is not sufficiently achieved.

The polyalkylene glycol represented by the above general formula (V) include polyalkylene glycols having hydroxyl groups at the chain ends. Polyalkylene glycol having hydroxyl groups at the chain ends can be used without problems as long as the content of the hydroxyl group at the chain ends is 50% by mole or smaller based on the total number of the groups at the chain ends. When the above content exceeds 50% by mole, the hygroscopic property increases and the viscosity index decreases. Therefore, such a content is not preferable.

As the polyalkylene glycol described above, polyoxypropylene glycol dimethyl ethers represented by the general formula:

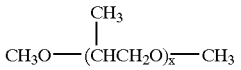

wherein x represents a number of 6 to 80, and polyoxyethylene-polyoxypropylene glycol dimethyl ethers represented by the general formula:

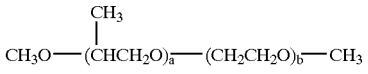

wherein a and b each represent a number of 1 or greater and the sum of the numbers represented by a and b is in the range of 6 to 80, are preferable from the standpoint of the economy and the effect.

Polyoxypropylene glycol monobutyl ethers represented by the general formula:

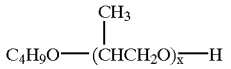

wherein x represents a number of 6 to 80, and polyoxypropylene glycol diacetates are preferable from the standpoint of the economy.

As the polyalkylene glycol represented by the above general formula (V), any compounds described in detail in Japanese Patent Application Laid-Open No. Heisei 2(1990)-305893 can be used.

In the present invention, as the above polyoxyalkylene glycol, polyoxyalkylene glycol derivatives having at least one constituting unit represented by the following general formula (VI):

(VI)

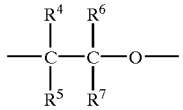

can be used. In general formula (VI), $R^4$ to $R^7$ each represent hydrogen atom, a hydrocarbon group having 1 to 10 carbon atoms or a group represented by general formula (VII):

(VII)

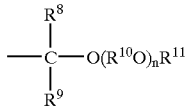

and at least one of $R^4$ to $R^7$ represents a group represented by general formula (VII). In general formula (VII), $R^8$ and $R^9$ each represent hydrogen atom, a monovalent hydrocarbon group having 1 to 10 carbon atoms or an alkoxyalkyl group having 2 to 20 carbon atoms, $R^{10}$ represents an alkylene group having 2 to 5 carbon atoms, a substituted alkylene group having alkyl groups as the substituents and 2 to 5 carbon atoms in the entire group or a substituted alkylene group having alkoxyalkyl groups as the substituents and 4 to 10 carbon atoms in the entire group, n represents an integer of 0 to 20 and $R^{11}$ represents a monovalent hydrocarbon group having 1 to 10 carbon atoms. In the above general formula (VI), $R^4$ to $R^7$ each represent hydrogen atom, a monovalent hydrocarbon group having 1 to 10 carbon atoms or a group represented by general formula (VII) as described above. As the monovalent hydrocarbon group having 1 to 10 carbon atoms, monovalent hydrocarbon groups having 6 or fewer carbon atoms are preferable and alkyl groups having 3 or fewer carbon atoms are more preferable.

In general formula (VII), $R^8$ and $R^9$ each represent hydrogen atom, a monovalent hydrocarbon group having 1 to 10 carbon atoms or an alkoxyalkyl group having 2 to 20 carbon atoms. Among these groups, alkyl groups having 3 or fewer carbon atoms and alkoxyalkyl groups having 6 or fewer carbon atoms are preferable.

$R^{10}$ represents an alkylene group having 2 to 5 carbon atoms, a substituted alkylene group having alkyl groups as the substituents and 2 to 5 carbon atoms in the entire group or a substituted alkylene group having alkoxyalkyl groups as the substituents and 4 to 10 carbon atoms in the entire group. It is preferable that $R^{10}$ represents ethylene group or a substituted ethylene group having 6 or fewer carbon atoms. $R^{11}$ represents a monovalent hydrocarbon group having 1 to 10 carbon atoms, preferably a hydrocarbon group having 6 or fewer carbon atoms and more preferably a hydrocarbon group having 3 or fewer carbon atoms.

In the above general formula (VI), at least one of $R^4$ to $R^7$ represents the group represented by the above general formula (VII). It is preferable that one of $R^4$ and $R^6$ represents the group represented by general formula (VII) and the other of $R^4$ and $R^6$, $R^5$ and $R^7$ each represent hydrogen atom or a monovalent hydrocarbon group having 1 to 10 carbon atoms.

The polyoxyalkylene glycol derivative comprises at least one constituting unit represented by general formula (VI). The polyalkylene glycol derivatives can be divided into the following three types of compounds: homopolymers comprising a single type of the constituting unit represented by general formula (VI); copolymers comprising two or more types of the constituting units represented by general formula (VI); and copolymers comprising the constituting units represented by general formula (VI) and other constituting units such as constituting units represented by general formula (VIII):

(VIII)

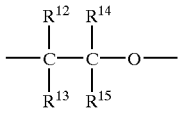

wherein $R^{12}$ to $R^{15}$ each represent hydrogen atom or an alkyl group having 1 to 3 carbon atoms.

Preferable examples of the homopolymer described above include homopolymers comprising 1 to 200 constituting unit A represented by general formula (VI) and having hydroxyl group, an acyloxyl group having 1 to 10 carbon atoms, an alkoxyl group having 1 to 10 carbon atoms or an aryloxyl group at each chain end.

Preferable examples of the copolymer include copolymers which comprise two types of constituting units A and B each represented by general formula (VI) each in a number of 1 to 200 and copolymers which comprise 1 to 200 constituting units A represented by general formula (VI) and 1 to 200 constituting units C represented by general formula (VII), each copolymer having hydroxyl group, an acyloxyl group having 1 to 10 carbon atoms, an alkoxyl group having 1 to 10 carbon atoms or an aryloxyl groups at each chain end. The above copolymers include alternating copolymers, random copolymers and block copolymers comprising constituting units A and constituting units B (or constituting units C) and graft copolymers comprising the main chain comprising constituting units A to which constituting units B are grafted.

2-5 Polyvinyl Ether

Examples of the polyvinyl ether compound preferably used as the base oil in the present invention include polyvinyl ether compounds comprising constituting units represented by general formula (IX):

(IX)

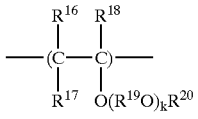

wherein $R^{16}$, $R^{17}$ and $R^{18}$ each represent hydrogen atom or a hydrocarbon group having 1 to 8 carbon atoms, the atom and the groups represented by $R^{16}$, $R^{17}$ and $R^{18}$ may be the same with or different from each other, $R^{19}$ represents a divalent hydrocarbon group having 1 to 10 carbon atoms, $R^{20}$ represents a hydrocarbon group having 1 to 20 carbon atoms, k represent numbers giving an average value of 0 to 10, the atom and the groups represented by $R^{16}$ to $R^{20}$ may be the same or different among different constituting units and, when a plurality of $R^{19}O$ are present, the plurality of $R^{19}O$ may represent the same group or different groups.

Polyvinyl ether compounds comprising block or random copolymers comprising the constituting units represented by the above general formula (IX) and constituting units represented by the following general formula (X):

(X)

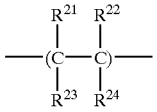

can also be used. In the above general formula (X), $R^{21}$ to $R^{24}$ each represent hydrogen atom or a hydrocarbon group having 1 to 20 carbon atoms and the atom and the groups represented by $R^{21}$ to $R^{24}$ may be the same with or different from each other and may be the same or different among different constituting units.

In the above general formula (IX), $R^{16}$, $R^{17}$ and $R^{18}$ each represent hydrogen atom or a hydrocarbon group having 1 to 8 carbon atoms and preferably 1 to 4 carbon atoms. The atom and the groups represented by $R^{16}$, $R^{17}$ and $R^{18}$ may be the same with or different from each other. Examples of the hydrocarbon group include alkyl groups such as methyl group, ethyl group, n-propyl group, isopropyl group, n-butyl group, isobutyl group, sec-butyl group, tert-butyl group, various types of pentyl groups, various types of hexyl groups, various types of heptyl groups and various types of octyl groups; cycloalkyl groups such as cyclopentyl group, cyclohexyl group, various types of methylcyclohexyl groups, various types of ethylcyclohexyl groups and various types of dimethylcyclohexyl groups; aryl groups such as phenyl group, various types of methylphenyl groups, various types of ethylphenyl groups and various types of dimethylphenyl groups; and arylalkyl groups such as benzyl group, various types of phenylethyl groups and various types of methylbenzyl groups. It is preferable that $R^{16}$, $R^{17}$ and $R^{18}$ represent hydrogen atom.

$R^{19}$ in general formula (IX) represents a divalent hydrocarbon group having 1 to 10 carbon atoms and preferably 2 to 10 carbon atoms. Examples of the divalent hydrocarbon group having 1 to 10 carbon atoms include divalent aliphatic groups such as methylene group, ethylene group, phenylethylene group, 1,2-propylene group, 2-phenyl-1,2-propylene group, 1,3-propylene group, various types of butylene groups, various types of pentylene groups, various types of hexylene groups, heptylene groups, various types of octylene groups, various types of nonylene groups and various types of decylene groups; alicyclic groups having two bonding portions on an alicyclic hydrocarbon such as cyclohexane, methyl-cyclohexane, ethylcyclohexane, dimethylcyclohexane and propylcyclo-hexane; divalent aromatic hydrocarbon groups such as various types of phenylene groups, various types of methylphenylene groups, various ethylphenylene groups, various types of dimethylphenylene groups and various types of naphthylene groups; alkylaromatic groups having one monovalent bonding portion on each of the alkyl portion and the aromatic portion of alkylaromatic hydrocarbons such as toluene, xylene and ethylbenzene; and alkylaromatic hydrocarbon groups having bonding portions on alkyl group portions of polyalkylaromatic hydrocarbons such as xylene and diethylbenzene. Among the above groups, aliphatic groups having 2 to 4 carbon atoms are preferable. k in general formula (IX) represent numbers showing the repeating numbers of the group represented by $R^{19}O$ and giving an average value in the range of 0 to 10 and preferably in the range of 0 to 5. When a plurality of $R^{19}O$ are present, the plurality of $R^{19}O$ may represent the same group or different groups.

$R^{20}$ in general formula (IX) represents a hydrocarbon group having 1 to 20 carbon atoms and preferably 1 to 10 carbon atoms. Examples of the hydrocarbon group represented by $R^{20}$ include alkyl groups such as methyl group, ethyl group, n-propyl group, isopropyl group, n-butyl group, isobutyl group, sec-butyl group, tert-butyl group, various types of pentyl groups, various types of hexyl groups, various types of heptyl groups, various types of octyl groups, various types of nonyl groups and various types of decyl groups; cycloalkyl groups such as cyclopentyl group, cyclohexyl group, various types of methylcyclohexyl groups, various types of ethylcyclohexyl groups, various types of propylcyclohexyl groups and various types of dimethylcyclohexyl groups; aryl groups such as phenyl group, various types of methylphenyl groups, various types of ethylphenyl groups, various types of dimethylphenyl groups, various types of propylphenyl groups, various types of trimethylphenyl groups, various types of butylphenyl groups and various types of naphthyl groups; and arylalkyl groups such as benzyl group, various types of phenylethyl groups, various types of methylbenzyl groups, various types of phenylpropyl groups and various types of phenylbutyl groups. The atom and the groups represented by $R^{16}$ to $R^{20}$ may be the same or different among different constituting units.

It is preferable that polyvinyl ether compound (1) comprising the constituting units represented by the above general formula (IX) has a ratio of the number by mole of carbon to the number by mole of oxygen in the range of 4.2 to 7.0. When this ratio is smaller than 4.2, the compound is hygroscopic to a great extent. When the ratio exceeds 7.0, miscibility with the refrigerant occasionally becomes poor.

In the above general formula (X), $R^{21}$ to $R^{24}$ each represent hydrogen atom or a hydrocarbon group having 1 to 20 carbon atoms and the atom and the groups represented by $R^{21}$ to $R^{24}$ may be the same with or different from each other. Examples of the hydrocarbon group having 1 to 20 carbon atoms include the groups described above as the examples of the hydrocarbon group represented by $R^{20}$ in the above general formula (IX). The atom and the groups represented by $R^{21}$ to $R^{24}$ may be the same or different among different constituting units.

It is preferable that polyvinyl ether compound (2) comprising a block or random copolymer comprising the constituting units represented by general formula (IX) and the constituting units represented by general formula (X) has a ratio of the number by mole of carbon to the number by mole of oxygen in the range of 4.2 to 7.0. When this ratio is smaller than 4.2, the compound is hygroscopic to a great extent. When the ratio exceeds 7.0, miscibility with the refrigerant occasionally becomes poor.

In the present invention, a mixture of the above polyvinyl ether compound (1) and the above polyvinyl ether compound (2) may also be used. Polyvinyl ether compounds (1) and (2) used in the present invention can be produced by polymerization of the corresponding vinyl ether monomer and copolymerization of the corresponding hydrocarbon monomer having an olefinic double bond and the corresponding vinyl ether monomer, respectively.

As the polyvinyl ether compound used in the present invention, polyvinyl ether compounds having the following structures at the chain ends are preferable:

Polyvinyl ether compounds which have one chain end having the structure represented by general formula (XI) or (XII):

(XI)

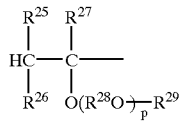

(XII)

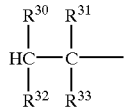

wherein $R^{25}$, $R^{26}$ and $R^{27}$ each represent hydrogen atom or a hydrocarbon group having 1 to 8 carbon atoms, the atoms and the groups represented by $R^{25}$, $R^{26}$ and $R^{27}$ may be the same with or different from each other, $R^{30}$, $R^{31}$, $R^{32}$ and $R^{33}$ each represent hydrogen atom or a hydrocarbon group having 1 to 20 carbon atom, the atoms and the groups represented by $R^{30}$, $R^{31}$, $R^{32}$ and $R^{33}$ may be the same with or different from each other, $R^{28}$ represents a divalent hydrocarbon group having 1 to 10 carbon atoms, $R^{29}$ represents a hydrocarbon group having 1 to 20 carbon atoms, p represent numbers giving an average value of 0 to 10 and, when a plurality of $R^{28}O$ are present, the plurality of $R^{28}O$ may represent the same group or different groups, and the other chain end having the structure represented by general formula (XIII) or (XIV):

(XIII)

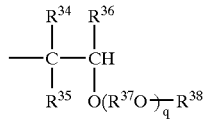

(XIV)

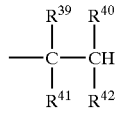

wherein $R^{34}$, $R^{35}$ and $R^{36}$ each represent hydrogen atom or a hydrocarbon group having 1 to 8 carbon atoms, the atoms and the groups represented by $R^{34}$, $R^{35}$ and $R^{36}$ may be the same with or different from each other, $R^{39}$, $R^{40}$, $R^{41}$ and $R^{42}$ each represent hydrogen atom or a hydrocarbon group having 1 to 20 carbon atom, the atoms and the groups represented by $R^{39}$, $R^{40}$, $R^{41}$ and $R^{42}$ may be the same with or different from each other, $R^{37}$ represents a divalent hydrocarbon group having 1 to 10 carbon atoms, $R^{38}$ represents a hydrocarbon group having 1 to 20 carbon atoms, q represent numbers giving an average value of 0 to 10 and, when a plurality of $R^{37}O$ are present, the plurality of $R^{37}O$ may represent the same group or different groups; and Polyvinyl ether compounds which have one chain end having the structure represented by the above general formula (XI) or (XII) and the other chain end having the structure represented by general formula (XV):

(XV)

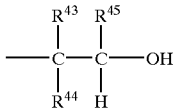

wherein $R^{43}$, $R^{44}$ and $R^{45}$ each represent hydrogen atom or a hydrocarbon group having 1 to 8 carbon atoms and the atoms and the groups represented by $R^{43}$, $R^{44}$ and $R^{45}$ may be the same with or different from each other.

Among the above polyvinyl ether compounds, the following compounds are preferably used in the present invention:

(1) Compounds which have one chain end having the structure represented by general formula (XI) or (XII) and the other chain end having the structure represented by general formula (XIII) or (XIV) and comprise the structural units represented by general formula (IX) in which $R^{16}$, $R^{17}$ and $R^{18}$ each represent hydrogen atoms, k represent numbers of 0 to 4, $R^{19}$ represents a divalent hydrocarbon group having 2 to 4 carbon atoms and $R^{20}$ represents a hydrocarbon group having 1 to 20 carbon atoms;

(2) Compounds which comprise the structural units represented by general formula (IX) alone and have one chain end having the structure represented by general formula (XI) and the other chain end having the structure represented by general formula (XIII), wherein $R^{16}$, $R^{17}$ and $R^{18}$ in general formula (IX) each represent hydrogen atom, k represent numbers of 0 to 4, $R^{19}$ represents a divalent hydrocarbon group having 2 to 4 carbon atoms and $R^{20}$ represents a hydrocarbon group having 1 to 20 carbon atoms;

(3) Compounds which have one chain end having the structure represented by general formula (XI) or (XII) and the other chain end having the structure represented by general formula (XV) and comprise the structural units represented by general formula (IX) in which $R^{16}$, $R^{17}$ and $R^{18}$ each represent hydrogen atom, k represent numbers of 0 to 4, $R^{19}$ represents a divalent hydrocarbon group having 2 to 4 carbon atoms and $R^{20}$ represents a hydrocarbon group having 1 to 20 carbon atoms; and (4) Compounds which comprise the structural units represented by general formula (IX) alone and have one chain end having the structure represented by general formula (XII) and the other chain end having the structure represented by general formula (XIV), wherein $R^{16}$, $R^{17}$ and $R^{18}$ in general formula (IX) each represent hydrogen atom, k represent numbers of 0 to 4, $R^{19}$ represents a divalent hydrocarbon group having 2 to 4 carbon atoms and $R^{20}$ represents a hydrocarbon group having 1 to 20 carbon atoms.

In the present invention, polyvinyl ether compounds which comprise the structural unit represented by the above general formula (IX) and have one chain end having the structure represented by the above general formula (XI) and the other chain end having the structure represented by the following general formula (XVI):

(XVI)

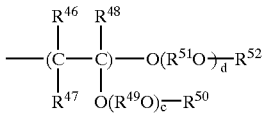

can also be used. In general formula (XVI) $R^{46}$, $R^{47}$ and $R^{48}$ each represent hydrogen atom or a hydrocarbon group having 1 to 8 carbon atoms and the atoms and the groups represented by $R^{46}$, $R^{47}$ and $R^{48}$ may be the same with or different from each other; $R^{49}$ and $R^{51}$ each represent a divalent hydrocarbon group having 2 to 10 carbon atoms and may represent the same group or different groups; $R^{50}$ and $R^{52}$ each represent a hydrocarbon group having 1 to 10 carbon atoms and may represent the same group or different groups; c and d each represent numbers giving an average value of 0 to 10 and may represent the same number or different numbers; when a plurality of $R^{49}O$ are present, the plurality of $R^{49}O$ may represent the same group or different groups; and, when a plurality of $R^{51}O$ are present, the plurality of $R^{51}O$ represent the same group or different groups. Further examples of the polyvinyl ether compounds which can be used in the present invention include homopolymers or copolymers of alkyl vinyl ethers comprising structural units represented by general formula (XVII) or (XVIII):

(XVII)

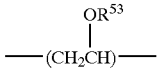

(XVIII)

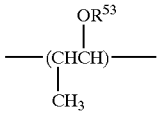

wherein $R^{53}$ represents a hydrocarbon group having 1 to 8 carbon atoms, and having a weight-average molecular weight of 300 to 5,000 and one chain end having the structure represented by general formula (XIX) or (XX):

(XIX)

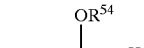

(XX)

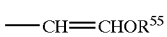

wherein $R^{54}$ represents an alkyl group having 1 to 3 carbon atoms and $R^{55}$ represents a hydrocarbon group having 1 to 8 carbon atoms.

Still further examples of the polyvinyl ether compound described above include the compounds described in detail in Japanese Patent Application Laid-Open No. Heisei 6(1994)-128578 and Japanese Patent Application Nos. Heisei 5(1993)-125649, Heisei 5(1993)-125650 and Heisei 5(1993)-303736.

2-6 Polyester

As the polyester used as the base oil in the present invention, (i) esters of polyhydric alcohols and (ii) esters of polybasic carboxylic acids are preferable.

(i) Ester of Polyhydric Alcohols

As the ester of a polyhydric alcohol, an esters of an aliphatic polyhydric alcohol and a linear or branched fatty acid can be used. Examples of the aliphatic polyhydric alcohol for forming the ester include ethylene glycol, propylene glycol, butylene glycol, neopentyl glycol, trimethylolethane, ditrimethylolethane, trimethylolpropane, ditrimethylolpropane, glycerol, pentaerythritol, dipentaerythritol, tripentaerythritol and sorbitol.

As the fatty acid, fatty acids having 3 to 12 carbon atoms can be used. Preferable examples of the fatty acid include propionic acid, butyric acid, pivalic acid, valeric acid, caproic acid, heptanoic acid, octanoic acid, nonanoic acid, decanoic acid, dodecanoic acid, isovaleric acid, neopentanoic acid, 2-methylbutyric acid, 2-ethylbutyric acid, 2-methylhexanoic acid, 2-ethylhexanoic acid, isooctanoic acid, isononanoic acid, isodecanoic acid, 2,2-dimethyloctanoic acid, 2-butyloctanoic acid and 3,5,5-trimethyl-hexanoic acid. Partial esters of an aliphatic polyhydric alcohol and a linear or branched fatty acid can also be used.

Preferable examples of the ester of an aliphatic polyhydric alcohol and a linear or branched fatty acid include esters of pentaerythritol, dipentaerythritol or tripentaerythritol and fatty acids having 5 to 12 carbon atoms and preferably 5 to 9 carbon atoms such as valeric acid, hexanoic acid, heptanoic acid, 2-methylhexanoic acid, 2-ethylhexanoic acid, isooctanoic acid, isononanoic acid, isodecanoic acid, 2,2-dimethyloctanoic acid, 2-butyloctanoic acid and 3,5,5-trimethylhexanoic acid.

Partial esters of an aliphatic polyhydric alcohol and a linear or branched fatty acid having 3 to 9 carbon atoms and complex esters of an aliphatic polyhydric alcohol and an aliphatic dibasic acid or an aromatic dibasic acid can also be used. In the complex ester, it is preferable that a fatty acid having 5 to 7 carbon atoms and more preferably 5 or 6 carbon atoms is used. As the above fatty acid, valeric acid, hexanoic acid, isovaleric acid, 2-methylbutyric acid, 2-ethylbutyric acid or a mixture of these acids can be used. Fatty acids obtained by mixing a fatty acid having 5 carbon atoms and a fatty acid having 6 carbon atoms in amounts such that the ratio of the amounts by weight is in the range of 10:90 to 90:10 are preferably used. Examples of the aliphatic dibasic acid used for esterification of the polyhydric alcohol in combination with the fatty acid include succinic acid, adipic acid, pimelic acid, suberic acid, azelaic acid, sebacic acid, undecanedicarboxylic acid, dodecanedicarboxylic acid, tridecanedicarboxylic acid and docosanedicarboxylic acid. Examples of the aromatic dibasic acid used for the esterification include phthalic acid and isophthalic acid. In the esterification reaction for preparing the complex ester, the polyhydric alcohol and the basic acid in prescribed relative amounts are reacted to form a partial ester, which is then reacted with the fatty acid. The reactions of the dibasic acid and the fatty acid may be conducted in a reversed order. The dibasic acid and the fatty acid may also be used for the reaction after being mixed together.

An ester of a polyhydric alcohol obtained by reacting an acid fluoride represented by the following general formula (XXI):

(XXI)

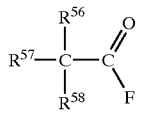

with a polyhydric alcohol can be advantageously used due to a small water absorption at saturation (Japanese Patent Application Laid-Open No. Heisei 9(1997)-157219). In the above general formula (XXI), $R^{56}$ to $R^{58}$ each represent an alkyl group having 1 to 13 carbon atoms, groups having 4 or more carbon atoms all have at least one branched structure and the number of carbon atom in the entire groups represented by $R^{56}$ to $R^{58}$ is in the range of 3 to 23.

(ii) Ester of Polybasic Carboxylic Acid

Examples of the ester of dicarboxylic acid include dialkyl esters having 16 to 22 carbon atoms of an aliphatic or aromatic dicarboxylic acid.

Examples of the aliphatic dicarboxylic acid include succinic acid, glutaric acid, adipic acid, pimelic acid, suberic acid, azelaic acid, sebacic acid, undecanedicarboxylic acid, dodecanedicarboxylic acid, tridecane-dicarboxylic acid and docosanedicarboxylic acid. Examples of the aromatic dibasic acid include phthalic acid and isophthalic acid. As the alcohol component, an alcohol having 5 to 8 carbon atoms can be used. Examples of the alcohol component include amyl alcohol, hexyl alcohol, heptyl alcohol and octyl alcohol. Preferable examples of the ester include dioctyl adipate, diisoheptyl adipate, dihexyl sebacate, diheptyl succinate, dioctyl phthalate, diisoheptyl phthalate and diisoamyl phthalate.

Examples of the polybasic carboxylic acid constituting the ester of a polybasic carboxylic acid having a functionality of three or greater include aliphatic polybasic carboxylic acids such as 1,2,3,4-butanetetracarboxylic acid and aromatic polybasic carboxylic acids such as trimellitic acid and pyromellitic acid. Examples of the alcohol component include monohydric alcohols having a linear chain or branched chain alkyl group having 3 to 12 carbon atoms and monoalcohol compounds of polyalkylene glycols represented by $H—(R'O)_n—R$, wherein R' represents an alkylene group having 2 to 8 carbon atoms, R represents an alkyl group having 1 to 10 carbon atoms and n represents an integer of 1 to 10. An ester obtained by esterification of the above polybasic carboxylic acid and the above monohydric alcohol or a complex ester obtained by esterification of a combination of the above polybasic carboxylic acid, the above monohydric alcohol and a polyhydric alcohol such as ethylene glycol and propylene glycol can be used.

Examples of the ester of an alicyclic polybasic carboxylic acid include esters of polycarboxylic acids represented by the following general formula (XXII):

(XXII)

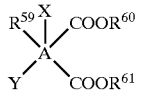

wherein A represents cyclohexane ring or cyclohexene ring, $R^{59}$ represents hydrogen atom or methyl group, X represents hydrogen atom or $COOR^{62}$, Y represents hydrogen atom or $COOR^{63}$ and $R^{60}$ and $R^{61}$ each represent an alkyl group having 3 to 18 carbon atoms or a cycloalkyl group having 3 to 10 carbon atoms and may represent the same group or different groups. The above ester can be prepared by esterification of a prescribed acid component and a prescribed alcohol component in accordance with a conventional process, preferably, under an atmosphere of an inert gas such as nitrogen in the presence or absence of an esterification catalyst under heating and stirring.

Examples of the acid component include cycloalkanepolycarboxylic acids, cycloalkenepolycarboxylic acids and anhydrides of these acids. The above compound may be used singly or as a mixture of two or more. Specific examples of the acid component include 1,2-cyclohexanedicarboxylic acid, 4-cyclohexene-1,2-dicarboxylic acid, 1-cyclohexene-1,2-dicarboxylic acid, 1,3-cyclohexanedicarboxylic acid, 1,4-cyclohexanedicarboxylic acid, 3-methyl-1,2-cyclohexanedicarboxylic acid, 4-methyl-1,2-cyclohexanedicarboxylic acid, 3-methyl-4-cyclohexene-1,2-dicarboxylic acid, 4-methyl-4-cyclohexene-1,2-dicarboxylic acid, 1,2,4-cyclohexanetricarboxylic acid, 1,3,5-cyclohexanetricarboxylic acid, 1,2,4,5-cyclohexanetetracarboxylic acid and anhydrides of these acids. Among these acids, 1,2-cyclohexanedicarboxylic acid, 3-methyl-1,2-cyclohexane-dicarboxylic acid, 4-methyl-1,2-cyclohexanedicarboxylic acid, 4-cyclohexene-1,2-dicarboxylic acid, 3-methyl-4-cyclohexene-1,2-dicarboxylic acid, 4-methyl-4-cyclohexene-1,2-dicarboxylic acid and anhydrides of these acids are more preferable.

Examples of the above alcohol component include linear chain or branched chain aliphatic alcohols having 3 to 18 carbon atoms and alicyclic alcohols having 3 to 10 carbon atoms. Specific examples of the linear chain aliphatic alcohol include n-propyl alcohol, n-butanol, n-pentanol, n-hexanol, n-heptanol, n-octanol, n-nonanol, n-decanol, n-undecanol, n-dodecanol, n-tetradecanol, n-hexadecanol and n-octadecanol.

Specific examples of the branched chain aliphatic alcohol include isopropanol, isobutanol, sec-butanol, isopentanol, isohexanol, 2-methylhexanol, 2-methylheptanol, isoheptanol, 2-ethylhexanol, 2-octanol, isooctanol, 3,5,5-trimethylhexanol, isodecanol, isoundecanol, isotridecanol, isotetradecanol, isohexadecanol, isooctadecanol and 2,6-dimethyl-4-heptanol. Examples of the alicyclic alcohol include cyclohexanol, methylcyclohexanol and dimethylcyclohexanol.

Preferable examples among the esters of alicyclic polycarboxylic acids obtained from the above polybasic carboxylic acids and the above alcohols include diisobutyl 1,2-cyclohexanedicarboxylate, dicyclohexyl 1,2-cyclohexanedicarboxylate, diisoheptyl 1,2-cyclohexanedicarboxylate, (2-ethylhexyl) 1,2-cyclohexanedicarboxylate, di(3,5,5-trimethylhexyl) 1,2-cyclohexanedicarboxylate, di(2,6-dimethyl-4-heptyl) 1,2-cyclohexane-dicarboxylate, diisodecyl 1,2-cyclohexanedicarboxylate, diisoundecyl 1,2-cyclohexanedicarboxylate, dicyclohexyl 4-cyclohexene-1,2-dicarboxylate, diisoheptyl 4-cyclohexene-1,2-dicarboxylate, di(2-ethylhexyl) 4-cyclohexene-1,2-dicarboxylate, di(3,5,5-trimethylhexyl) 4-cyclohexene-1,2-dicarboxylate, di(3,5,5-trimethylhexyl) 3-methyl-1,2-cyclohexane-dicarboxylate, di(3,5,5-trimethylhexyl) 4-methyl-1,2-cyclohexane-dicarboxylate, di(3,5,5-trimethylhexyl) 3-methyl-4-cyclohexene-1,2-dicarboxylate, di(3,5,5-trimethylhexyl) 4-methyl-4-cyclohexene-1,2-dicarboxylate and tetra(3,5,5-trimethylhexyl) 1,2,4,5-cyclohexane-tetracarboxylate.

To the above ester of an alicyclic polybasic carboxylic acid, esters other than the above ester (referred to as esters used in combination) may be mixed to improve the balance between the physical properties such as volume specific resistance and viscosity. Examples of the ester used in combination include esters of adipic acid, esters of azelaic acid, esters of sebacic acid, esters of phthalic acid, esters of trimellitic acid and esters of polyhydric alcohols. Examples of the alcohol component in the ester of a polyhydric alcohol include neopentyl glycol, trimethylolpropane, pentaerythritol and dipentaerythritol. Examples of the acid component include isobutyric acid, 2-ethylbutyric acid, isovaleric acid, pivalic acid, cyclohexanecarboxylic acid, 2-methylpentanoic acid, 2-ethylpentanoic acid, 2-methylhexanoic acid, 2-ethylhexanoic acid and 3,5,5-trimethylhexanoic acid.

Examples of the esters other than those described in (i) and (ii) include diesters obtained by esterification of addition products of alkylene oxides to monohydric alcohols with aliphatic dicarboxylic acids such as adipic acid, pimelic acid, suberic acid, azelaic acid, sebacic acid, undecanedicarboxylic acid, dodecanedicarboxylic acid and docosanedicarboxylic acid or aromatic dicarboxylic acids such as phthalic acid; and esters obtained by esterification of addition products of 1 to 10 moles of alkylene oxides to polyhydric alcohols such as glycerol and trimethylolpropane with fatty acids having 3 to 12 carbon atoms such as propionic acid, butyric acid, valeric acid, hexanoic acid, heptanoic acid, octanoic acid, nonanoic acid, decanoic acid, 2-methylhexanoic acid, 2-ethylhexanoic acid, isooctanoic acid, isononanoic acid, isodecanoic acid, 2,2-dimethyloctanoic acid and 2-butyloctanoic acid.

(iii) Other Polyesters

Examples of other polyesters include ester oligomers of fumaric acid and esters of hydroxypivalic acid.

The ester oligomer of fumaric acid is a homopolymer of an ester of fumaric acid or a copolymer of an ester of fumaric acid with an unsaturated aliphatic hydrocarbon. The ester oligomer of fumaric acid is represented by the following general formula (XXIII):

(XXIII)

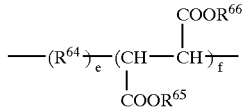

wherein $R^{64}$ represents an alkylene group, a substituted alkylene group or an alkylene oxide group, $R^{65}$ and $R^{66}$ represent an alkyl group having 1 to 9 carbon atoms, allyl group or a polyalkylene oxide group which may have substituents at the ends, $R^{65}$ and $R^{66}$ may represent the same group or different groups, e represents 0 or an integer of 1 or greater, f represents an integer of 1 or greater and the amount of the group represented $R^{64}$ is 50% or less of the entire molecule. Specific examples of the above compound include ester oligomers of diethyl fumarate and ester oligomers of dibutyl fumarate.

In the above general formula (XIX), the structures of the both ends of the molecule have residue groups of the initiator used in the polymerization and are not shown.

Further examples of the other ester include copolymers of alkyl esters of fumaric acid comprising 1 to 50% by mole of the structural unit represented by the following general formula (XXIV):

(XXIV)

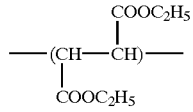

and 50 to 99% by mole of the structural unit represented by the following general formula (XXV):

(XXV)

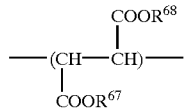

wherein $R^{67}$ and $R^{68}$ each represent an alkyl group having 3 to 8 carbon atoms and may represent the same group or different groups.

Examples of the ester of hydroxypivalic acid include compounds represented by the following general formula (XXVI):

(XXVI)

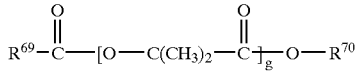

wherein $R^{69}$ and $R^{70}$ each represent an alkyl group having 2 to 10 carbon atoms and g represents an integer of 1 to 5.

2-7 Ester of Carbonic Acid

Preferable examples of the ester of carbonic acid used as the base oil in the present invention include compounds represented by the following general formula (XXVII):

(XXVII)

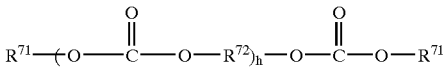

wherein $R^{71}$ represents an alkyl group having 2 to 10 carbon atoms, $R^{72}$ represents an alkylene group having 2 to 10 carbon atoms or a cycloalkylene group and h represents an integer of 1 to 4, and compounds represented by the following general formula (XXVIII):

(XXVIII)

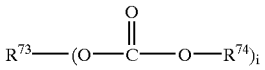

wherein $R^{73}$ represents a residue group of a polyhydric alcohol having 2 to 6 carbon atoms and hydroxyl group, $R^{74}$ represents an alkyl group having 2 to 10 carbon atoms and i represents an integer of 2 to 6. The above ester of carbonic acid can be prepared by transesterification of dimethyl carbonate and an alcohol in the presence of a basic catalyst.

Further example of the ester of carbonic acid include compounds represented by the following general formula (XXIX):

(XXIX)

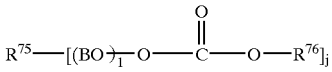

wherein $R^{75}$ represents an alkyl group having 1 to 10 carbon atoms, $R^{76}$ represents an alkyl group having 2 to 10 carbon atoms, j represents an integer of 2 to 10, l represents an integer of 2 to 100 and —BO— represents a group expressed by $—CH_2—CH(CH_3)—O—$ or $—CH_2—CH_2—O—$. This ester of carbonic acid can be prepared, for example, by the reaction of carbonic acid and an alkylene oxide. In the reaction of the alkylene oxide, ethylene oxide alone, propylene oxide alone or a mixture of ethylene oxide and propylene oxide may be used.

In the present invention, the advantageous effect can be exhibited by using any of the above base oils. As the base oil of a refrigerator oil, for example, the base oils described in 2-4 to 2-7 are occasionally preferable due to excellent miscibility with the refrigerant. As the base oil of a lubricating oil for other apparatuses and machines, for example, the base oils described in 2-1 to 2-3 are occasionally preferable.

As the base oil used in the present invention, the above base oil may be used alone or as a mixture of two or more. For example, two or more base oils described in 2-1 to 2-3 may be mixed together or two or more base oils described in 2-4 to 2-7 may be mixed together.

3. Other Components 3-1 Metal Salt of Carboxylic Acid

The other components which may be comprised in the lubricating oil of the present invention include a metal salt of carboxylic acid. As the metal salt of carboxylic acids, metal salts of carboxylic acids having 3 to 60 carbon atoms are preferable, metal salts of a fatty acids having 3 to 30 carbon atoms are more preferable and metal salts of fatty acids having 12 to 30 carbon atoms are most preferable. Metal salt of dimer acids and trimer acids of the fatty acids described above and metal salts of dicarboxylic acids having 3 to 30 carbon atoms are also preferable. Among these metal salts of carboxylic acids, in particular, metal salts of fatty acids having 12 to 30 carbon atoms and metal salts of dicarboxylic acids having 3 to 30 carbon atoms are preferable.

As the metal constituting the metal salt of a carboxylic acid, alkali metals and alkaline earth metals are preferable and alkali metals are more preferable.

Examples of the carboxylic acid constituting the metal salt of a carboxylic acid include various carboxylic acids such as saturated aliphatic carboxylic acids, unsaturated aliphatic carboxylic acids, aliphatic dicarboxylic acids and aromatic carboxylic acids. Examples of the saturated aliphatic carboxylic acid include linear saturated fatty acids such as caproic acid, caprylic acid, capric acid, lauric acid, myristic acid, palmitic acid, stearic acid, arachic acid, cerotic acid and laccelic acid; and branched fatty acids such as isopentanoic acid, 2-methylpentanoic acid, 2-methylbutanoic acid, 2,2-dimethylbutanoic acid, 2-methylhexanoic acid, 5-methylhexanoic acid, 2,2-dimethylheptanoic acid, 2-ethyl-2-methyl-butanoic acid, 2-ethylhexanoic acid, dimethylhexanoic acid, 2-n-propylpentanoic acid, 3,5,5-trimethylhexanoic acid, dimethyloctanoic acid, isotridecanoic acid, isomyristic acid, isostearic acid, isoarachic acid and isohexanoic acid. Examples of the unsaturated aliphatic carboxylic acid include palmitoleic acid, oleic acid, elaidic acid, linolic acid, linolenic acid and unsaturated hydroxycarboxylic acids such as ricinolic acid. Examples of the aliphatic dicarboxylic acid include adipic acid, azelaic acid and sebacic acid. Examples of the aromatic carboxylic acid include benzoic acid, phthalic acid, trimellitic acid and pyromellitic acid. Further examples of the carboxylic acid include alicyclic fatty acids such as naphthenic acid. The carboxylic acid may be used singly or in combination of two or more.

The metal constituting the metal salt of a carboxylic acid is not particularly limited and various metals can be used. Examples of the metal include alkali metals such as lithium, potassium and sodium; alkaline earth metals such as magnesium, calcium and strontium and other metals such as zinc, nickel and aluminum. Among the above metals, alkali metals and alkaline earth metals are preferable and alkali metals are more preferable. A single metal or a combination of two or more metals may be used in combination with one carboxylic acid described above.

In the refrigerating oil composition of the present invention, the amount of the metal salt of a carboxylic acid described above is preferably in the range of 0.001 to 5% by weight and more preferably in the range of 0.005 to 3% by weight. When the amount is less than 0.001% by weight, wear resistance is not sufficient. When the amount exceeds 5% by weight, stability occasionally decreases.

As for the process for producing the composition of the present invention comprising the metal salt of a carboxylic acid, it is sufficient that the metal salt of a carboxylic acid is mixed into the base oil and various processes can be used. It is effective that the composition is produced in accordance with the following process so that solubility of the metal of a carboxylic acid into the base oil can be improved. The carboxylic acid and an alkali hydroxide are placed into a solvent and the metal salt of the carboxylic acid is dissolved or dispersed in the solvent by the reaction at the room temperature or under heating so that the metal salt of the carboxylic acid can be dissolved or dispersed in the solvent in advance. The metal salt of the carboxylic acid dissolved or dispersed in the solvent is added to, mixed with and dispersed into the base oil without further treatments. By dissolving or dispersing the metal salt of the carboxylic acid into the solvent in advance and adding the obtained solution or dispersion of the metal salt of the carboxylic acid into the base oil, the object composition can be efficiently produced.

As the solvent used above, various solvents can be used. Examples of the solvent include monohydric alcohols such as n-butyl alcohol, isobutyl alcohol, sec-butyl alcohol, t-butyl alcohol, n-amyl alcohol, isoamyl alcohol, sec-amyl alcohol, n-hexyl alcohol, methylamyl alcohol, ethylbutyl alcohol, heptyl alcohol, n-octyl alcohol, sec-octyl alcohol, 2-ethylhexyl alcohol, isooctyl alcohol, n-nonyl alcohol, 2,6-dimethyl-4-heptanol, n-decyl alcohol and cyclohexanol; glycols and polyhydric alcohols such as ethylene glycol, diethylene glycol, triethylene glycol, tetraethylene glycol, propylene glycol, dipropylene glycol, 1,4-butylene glycol, 2,3-butylene glycol, hexylene glycol, octylene glycol and glycerol; cellosolves such as ethylene glycol monomethyl ether, ethylene glycol ethyl ether, ethylene glycol diethyl ether, ethylene glycol butyl ether, ethylene glycol dibutyl ether, ethylene glycol phenyl ether, ethylene glycol benzyl ether, ethylene glycol ethyl hexyl ether, diethylene glycol ethyl ether, diethylene glycol diethyl ether, diethylene glycol butyl ether, diethylene glycol dibutyl ether, propylene glycol methyl ether, propylene glycol ethyl ether, propylene glycol butyl ether, dipropylene glycol methyl ether, dipropylene glycol ethyl ether, tripropylene glycol methyl ether, tetraethylene glycol dimethyl ether and tetraethylene glycol dibutyl ether; crown ethers such as benzo-15-crown-5, benzo-12-crown-4, benzo-18-crown-6 and dibenzo-18-crown-6; ketones such as ethyl butyl ketone, dipropyl ketone, methyl amyl ketone, methyl hexyl ketone and diisobutyl ketone; and fatty acids such as fatty acids having 3 to 30 carbon atoms described above.

The concentration of the salt of a carboxylic acid dissolved or dispersed into the above solvent is not particularly limited and can be suitably selected in accordance with the situation.

When the metal salt of a carboxylic acid is comprised in combination with the cyclic organic phosphorus compound represented by general formula (I), the extreme pressure property is further improved and the excellent lubricating oil exhibiting excellent stability under the atmosphere of the refrigerant can be constituted.

3-2 Phosphorus-Based Extreme Pressure Agent

Examples of the phosphorus-based extreme pressure agent which may be comprised in the lubricating oil composition of the present invention include esters of phosphoric acid, acidic esters of phosphoric acid, esters of phosphorous acid, acidic esters of phosphorous acid and amine salts of these esters. Examples of the esters of phosphoric acid include triaryl phosphates, trialkyl phosphates, trialkylaryl phosphates, triarylalkyl phosphates and trialkenyl phosphates. Specific examples of the esters of phosphoric acid include triphenyl phosphate, tricresyl phosphate, benzyl diphenyl phosphate, ethyl diphenyl phosphate, tributyl phosphate, ethyl dibutyl phosphate, cresyl diphenyl phosphate, dicresyl phenyl phosphate, ethylphenyl diphenyl phosphate, diethylphenyl phenyl phosphate, propylphenyl diphenyl phosphate, dipropylphenyl phenyl phosphate, triethylphenyl phosphate, tripropylphenyl phosphate, butylphenyl diphenyl phosphate, dibutylphenyl phenyl phosphate, tributylphenyl phosphate, trihexyl phosphate, tri(2-ethylhexyl) phosphate, tridecyl phosphate, trilauryl phosphate, trimyristyl phosphate, tripalmityl phosphate, tristearyl phosphate and trioleyl phosphate.

Examples of the acidic ester of phosphoric acid include 2-ethylhexyl acid phosphate, ethyl acid phosphate, butyl acid phosphate, oleyl acid phosphate, tetracosyl acid phosphate, isodecyl acid phosphate, lauryl acid phosphate, tridecyl acid phosphate, stearyl acid phosphate and isostearyl acid phosphate.

Examples of the ester of phosphorous acid include triethyl phosphite, tributyl phosphite, triphenyl phosphite, tricresyl phosphite, tri(nonylphenyl) phosphite, tri(2-ethylhexyl) phosphite, tridecyl phosphite, trilauryl phosphite, triisooctyl phosphite, diphenyl isodecyl phosphite, tristearyl phosphite, trioleyl phosphite and 2-ethylhexyl diphenyl phosphite.

Examples of the acidic ester of phosphorous acid include dibutyl hydrogenphosphite, dilauryl hydrogenphosphite, dioleyl hydrogen-phosphite, distearyl hydrogenphosphite and diphenyl hydrogenphosphite.

Examples of the amines forming amine salts with the above esters include monosubstituted amines, disubstituted amines and trisubstituted amines represented by general formula (XXX):

$$R^{77}_{s}NH_{3-s} \qquad \text{(XXX)}$$

wherein $R^{77}$ represents an alkyl group or an alkenyl group having 3 to 30 carbon atoms, an aryl group or an aralkyl group having 6 to 30 carbon atoms or a hydroxyalkyl group having 2 to 30 carbon atoms, s represents a number of 1, 2 or 3 and, when a plurality of $R^{77}$ are present, the plurality of $R^{77}$ may represent the same group or different groups. The alkyl group and the alkenyl group having 3 to 30 carbon atoms which are represented by $R^{77}$ in general formula (XXX) may be any of linear groups, branched groups and cyclic groups.

Examples of the monosubstituted amine include butylamine, pentylamine, hexylamine, cyclohexylamine, octylamine, laurylamine, stearylamine, oleylamine and benzylamine. Examples of the disubstituted amine include dibutylamine, dipentylamine, dihexylamine, dicyclohexylamine, dioctylamine, dilaurylamine, distearylamine, dioleylamine, dibenzylamine, stearylmonoethanolamine, decyl-monoethanolamine, hexylmonopropanolamine, benzylmonoethanolamine, phenylmonoethanolamine and tolylmonopropanolamine. Examples of the trisubstituted amine include tributylamine, tripentylamine, trihexylamine, tricyclohexylamine, trioctylamine, trilaurylamine, tristearylamine, trioleylamine, tribenzylamine, dioleylmonoethanolamine, dilaurylmonopropanolamine, dioctylmonoethanolamine, dihexylmonopropanolamine, dibutylmonopropanolamine, oleyldiethanolamine, stearyldipropanolamine, lauryldiethanolamine, octyldipropanolamine, butyldiethanolamine, benzyldiethanolamine, phenyldiethanolamine, tolyldipropanolamine, xylyldiethanolamine, triethanolamine and tripropanolamine.

Among these phosphorus-based extreme pressure agents, tricresyl phosphate, tri(nonylphenyl) phosphite, dioleyl hydrogenphosphite and 2-ethylhexyl diphenyl phosphite are preferable from the standpoint of the extreme pressure property and the friction property.

In the present invention, the extreme pressure agents described above may be used singly or in combination of two or more. It is preferable that the extreme pressure agent is used in an amount in the range of 0.005 to 5% by weight based on the amount of the base oil. When the amount is less than 0.005% by weight, there is the possibility that the extreme pressure property and the lubrication property are insufficient. When the amount exceeds 5% by weight, there is the possibility that formation of sludge is promoted.

When the above phosphorus-based extreme pressure agent is comprised in combination with the cyclic organic phosphorus compound represented by general formula (I), the extreme pressure property is further improved and the excellent lubricating oil exhibiting excellent stability under the atmosphere of the refrigerant can be constituted.

3-3 Acid Catcher

Examples of the acid scavenger which may be comprised in the lubricating oil composition of the present invention include epoxy compounds such as phenyl glycidyl ether, alkyl glycidyl ethers, alkylene glycol glycidyl ethers, cyclohexene oxide, α-olefin oxides and epoxidized soy bean oil. Among the above acid scavengers, phenyl glycidyl ether, alkyl glycidyl ethers, alkylene glycol glycidyl ethers, cyclohexene oxide and α-olefin oxides are preferable from the standpoint of the miscibility.

In the present invention, the acid catcher may be used singly or in combination of two or more. It is preferable that the amount is in the range of 0.005 to 5% by weight based on the amount of the base oil. When the amount is less than 0.005% by weight, there is the possibility that the effect of adding the acid catcher is not exhibited. When the amount exceeds 5% by weight, there is the possibility that sludge is formed. When the above acid catcher is comprised, the effects of improving stability and maintaining the extreme pressure property can be exhibited. The effect is remarkably exhibited in the case of the refrigerator oil.

3-4 Antioxidant

As the antioxidant which may be comprised in the lubricating oil composition of the present invention, phenol-based antioxidants such as 2,6-di-tert-butyl-4-methylphenol, 2,6-di-tert-butyl-4-ethylphenol and 2,2'-methylene-bis(4-methyl-6-tert-butylphenol) and amine-based antioxidants such as phenyl-α-naphthylamine, phenyl-β-naphthylamine and N,N'-diphenyl-p-phenylenediamine are used. Among these antioxidants, phenol-based antioxidants are preferable. When the above antioxidant is comprised, the effect of improving stability is exhibited and, at the same time, the effect of the extreme pressure agent is maintained.

The lubricating oil composition of the present invention may further comprise conventional various additives such as copper inactivating agents such as benzotriazole and derivatives thereof and defoaming agents such as silicone oils and fluorinated silicone oils in suitable amounts as long as the object of the present invention is not adversely affected. The additives are comprised in the lubricating oil composition in an amount of 0.5 to 10% by weight.

4. Application of the Lubricating Oil Composition

The lubricating oil composition of the present invention can be effectively applied to any lubricating oils to improve the extreme pressure property, seizure resistance and wear resistance. In particular, the lubricating oil composition can be used as the lubricating oil for bearings, gears and other apparatuses and machines such as hydraulic systems which are exposed to severe lubricating conditions.

The lubricating oil composition of the present invention is stable under various refrigerants and can improve the extreme pressure property, seizure resistance and wear resistance under the atmosphere of the refrigerants. Therefore, the lubricating oil composition is advantageous as the compression-type refrigerator oil.

In the present invention, the refrigerant may be a carbon dioxide refrigerant; a hydrocarbon refrigerant such as ethane, propane, n-butane, isobutane, n-pentane and isopentane; an ammonia refrigerant; an ether refrigerant; or a refrigerant containing fluorine such as a hydrofluorocarbon or a fluorocarbon typical examples of which include 1,1,1,2-tetrafluoroethane (R134a), difluoromethane (R32), pentafluoro-ethane (R125) and 1,1,1-trifluoroethane (R143a) and chlorinated hydrofluorocarbons examples of which include monochlorofluoromethane (R22) and monochloropentafluoroethane (R115).

The refrigerant containing fluorine such as the hydrofluorocarbon and the fluorocarbon may be used singly or as a combination of two or more. Examples of the mixed refrigerant include a mixture of R32, R125 and R134a in relative amounts by weight of 23:25:52 (referred to as R407c, hereinafter); a mixture of R32, R125 and R134a in relative amounts by weight of 25:15:60; a mixture of R32 and R125 in relative amounts by weight of 50:50 (referred to as R410A, hereinafter); a mixture of R32 and R125 in relative amounts by weight of 45:55 (referred to as R410B, hereinafter); a mixture of R125, R143a and R134a in relative amounts by weight of 44:52:4 (referred to as R404A, hereinafter); and a mixture of R125 and R143a in relative amounts by weight of 50:50 (referred to as R507, hereinafter).

The chlorinated hydrofluorocarbons may also be used in combination of two or more. Examples of the mixed refrigerant include a mixture of R22 and R115 in relative amounts by weight of 49:51 (referred to as R502, hereinafter).

When a refrigerator is lubricated using the lubricating oil composition of the present invention as the refrigerator oil composition, it is preferable that the ratio of the amounts by weight of the refrigerant to the refrigerator oil composition is in the range of 99/1 to 10/90. When the amount of the refrigerant is smaller than the above range, the refrigerating ability decreases. When the amount of the refrigerant exceeds the above range, the lubricating property deteriorates. Therefore, amounts outside the above range are not preferable. From the above standpoint, it is more preferable that the ratio of the amounts by weight of the refrigerant to the refrigerator oil composition is in the range of 95/5 to 30/70.

Figure 2:
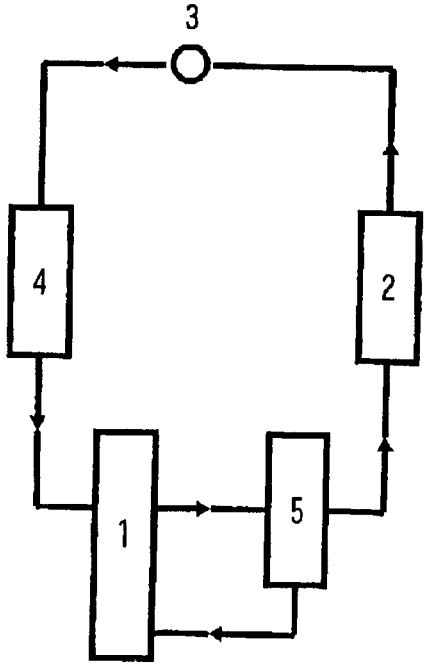
FIG. 2 shows a flow diagram which exhibits an example of the refrigerating cycle of the compression type of the "compressor-condenser-expansion valve-evaporator" system having an oil separator.
Figure 3:
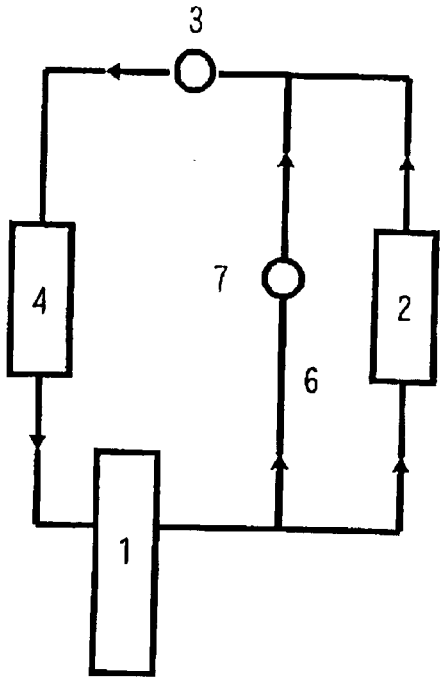
FIG. 3 shows a flow diagram which exhibits an example of the refrigerating cycle of the compression type of the "compressor-condenser-expansion valve-evaporator" system having a hot gas line.
Figure 4:
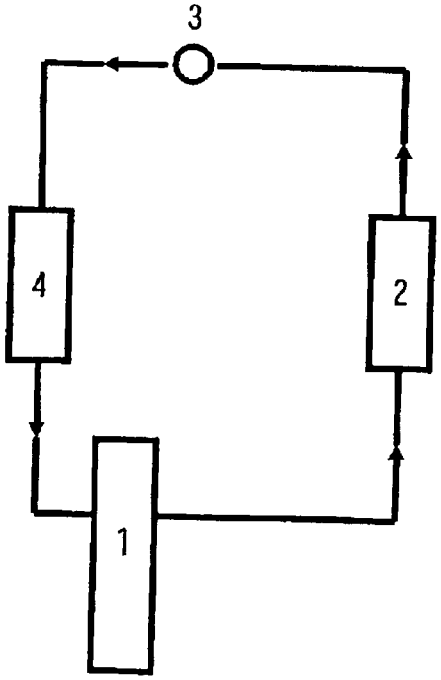
FIG. 4 shows a flow diagram which exhibits an example of the refrigerating cycle of the compression type of the "compressor-condenser-expansion valve-evaporator" system.

The refrigerator oil composition of the present invention can be applied to various types of refrigerators. In particular, the refrigerator oil composition of the present invention is advantageously applied to compression-type refrigerating cycles in compression-type refrigerators. For example, the advantageous effects can be exhibited when the refrigerator oil composition of the present invention is applied to compression-type refrigerating cycles having an oil separator and/or a hot gas line such as the refrigerating cycles shown in FIGS. 1 to 3. In general, a compression-type refrigerating cycle is constituted with a compressor, a condenser, an expansion valve and an evaporator. As the lubricating oil for a refrigerator, a lubricating oil exhibiting excellent miscibility with the refrigerant used for the refrigerator is used. However, when a refrigerant comprising carbon dioxide as the main component is used for the above refrigerating cycle and the refrigerator is lubricated with a conventional refrigerating oil, wear resistance is poor and a stable operation for a long period time cannot be achieved due to insufficient stability. In particular, the drawbacks are marked when a capillary tube is used as the expansion valve in the refrigerating cycle in electric refrigerators and small air conditioners, for example. The refrigerating oil composition of the present invention can be effectively used even when a compression-type refrigerating cycle having an oil separator and/or a hot gas line is operated using a refrigerant comprising carbon dioxide as the main component. For example, the refrigerating oil composition can be advantageously applied to refrigerators disclosed in Japanese Patent Application Laid-Open Nos. Heisei 4(1992)-183788, Heisei 8(1996)-259975, Heisei 8(1996)-240362, Heisei 8(1996)-253779, Heisei 8(1996)-240352, Heisei 5(1993)-17792, Heisei 8(1996)-226717 and Heisei 8(1996)-231972.

EXAMPLE

The present invention will be described more specifically with reference to examples in the following.

The test methods used in the examples were as follows.

[Test of the Extreme Pressure Property]

In accordance with the method of ASTM D2783 using four balls, the test of the resistance to load was conducted at a rotation speed of 1,800 rpm at the room temperature. From the maximum load showing no seizure (LNL) and the load of melting (WL), the load wear index (LWI) was calculated in accordance with the prescribed method. The greater the index, the more excellent the extreme pressure property and the resistance to load.

[Test of Stability]

Into an autoclave having an inner volume of 200 ml, 80 g of a sample oil, 40 g of a refrigerant gas and a metal catalyst containing copper, aluminum and iron were placed and water was added to the system in an amount such that the content of water was adjusted to 1,000 ppm. After the autoclave was closed and kept at 175° C. for 30 days, the sample oil was analyzed.

[Test of Seizure Resistance and Wear Resistance]

The friction tests were conducted under the atmosphere of a refrigerant in accordance with the Falex friction test in the closed system.

The conditions of the tests were as follows:

| Test of seizure resistance | |
|---|---|
| material of the pin: | AISI-3135 |
| material of the block: | AISI-1137 |
| amount of the oil: | 300 ml |
| pressure of the refrigerant: | 0.5 MPa |
| rotation speed: | 290 rpm |
| temperature of the oil: | 30° C. |

-continued

| | |
|---|---|
| conditioning | 1 minute under a prescribed load |
| Test of wear resistance | |
| material of the pin: | AISI-3135 |
| material of the block: | AISI-1137 |
| amount of the oil: | 300 ml |
| pressure of the refrigerant: | 0.5 MPa |
| rotation speed: | 290 rpm |
| temperature of the oil: | 50° C. |
| load of conditioning: | 1.33 N, except 667 N in Example 7 and in Comparative Example 13 |
| load: | 1,334 N |
| time of the test: | 30 minutes |

[Base Oil]

In the experiments in Examples and Comparative Examples, the base oils shown in Table 1 were used. To these base oils, 0.5% by weight of 2,6-di-tert-butyl-4-methylphenol and 1.5% by weight of an α-olefin oxide were added.

TABLE 1

| | Base oil | Kinematic viscosity at 40° C. ($mm^2/s$) | Kinematic viscosity at 100° C. ($mm^2/s$) | Viscosity index |
|---|---|---|---|---|
| MO | a naphthenic mineral oil*1 | 52.91 | 6.08 | 32 |
| AB | an alkylbenzene | 34.35 | 4.49 | −30 |
| POE-1 | an ester of an aliphatic carboxylic acid*2 | 19.01 | 4.52 | 158 |
| POE-2 | pentaerythritol/2-ethylhexanoic acid (0.2 moles) + 3,5,5-trimethylhexanoic acid (0.8 moles) | 60.23 | 7.68 | 88 |
| PVE-1 | polyethyl vinyl ether/polyisobutyl vinyl ether [9:1 by mole] copolymer | 70.33 | 8.2 | 85 |
| PVE-2 | polyethyl vinyl ether/polyisobutyl vinyl ether [8:2 by mole] copolymer | 33.74 | 5.21 | 76 |
| PAG-1 | polyoxypropylene glycol monomethyl ether | 44.43 | 9.91 | 206 |
| PAG-2 | polyoxyethyleneoxypropylene glycol mono-n-butyl ether [EP:PO = 1:9 by mole] | 101.9 | 20.1 | 223 |
| PC-1 | polycarbonate*3 | 64.59 | 9.5 | 126 |

*1Total acid value: 0.01 mg KOH/g; pour point: −35° C.; sulfur content: 0.03% by weight

*2An ester of trimethylolpropane and a mixed fatty acid (octanoic acid and decanoic acid)

*3A compound expressed by the following formula (a mixture of n = 1 to 10):

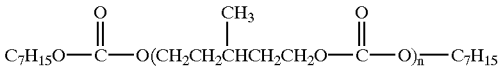

[Preparation of a Metal Salt of a Carboxylic Acid]

Using dipropylene glycol as the solvent, oleic acid, palmitic acid or sebacic acid as the carboxylic acid and potassium hydroxide or sodium hydroxide as the alkali hydroxide, the carboxylic acid and the alkali hydroxide were reacted and 30% by weight solutions of potassium oleate, sodium oleate, sodium palmitate and potassium sebacate were prepared.

Examples 1 to 6 and Comparative Examples 1 to 12

Using the compositions shown in Table 2, the load wear index (LWI) was measured. The results are shown in Table 2. In Table 2, TCP represents tricresyl phosphate and DOHP represents dioleyl hydrogenphosphite.

TABLE 2

| | Composition | | | | |
|---|---|---|---|---|---|
| | Base oil | Cyclic organic phosphorus compound*4 | TCP | DOHP | Load wear index (N) |
| Example 1 | MO | 0.05 | | | 266 |
| Comparative Example 1 | MO | | 0.5 | | 233 |
| Comparative Example 2 | MO | | | 0.5 | 255 |
| Example 2 | AB | 0.05 | | | 222 |
| Comparative Example 3 | AB | | 0.5 | | 201 |
| Comparative Example 4 | AB | | | 0.5 | 198 |
| Example 3 | POE-1 | 0.05 | | | 175 |
| Comparative Example 5 | POE-1 | | 0.5 | | 105 |
| Comparative Example 6 | POE-1 | | | 0.5 | 94 |
| Example 4 | PVE-1 | 0.05 | | | 445 |
| Comparative Example 7 | PVE-1 | | 0.5 | | 355 |
| Comparative Example 8 | PVE-1 | | | 0.5 | 362 |
| Example 5 | PVE-1 | 0.05 | | | 492 |
| Comparative Example 9 | PVE-1 | | 0.5 | | 387 |
| Comparative Example 10 | PVE-1 | | | 0.5 | 388 |
| Example 6 | PVE-1 | 0.05 | | | 467 |

TABLE 2-continued

| | Composition | | | | |
|---|---|---|---|---|---|
| | Base oil | Cyclic organic phosphorus compound*4 | TCP | DOHP | Load wear index (N) |
| Comparative Example 11 | PVE-1 | | 0.5 | | 377 |
| Comparative Example 12 | PVE-1 | | | 0.5 | 368 |

*4 9,10-Dihydro-9-oxa-10-phosphaphenanthrene-10-oxide (a compound represented by general formula (II))

Examples 7 to 13 and Comparative Examples 13 to 19

Using the compositions shown in Table 3, the test of stability, the test of seizure resistance and the test of the wear resistance were conducted in the refrigerants shown in Table 4. The results are shown in Table 4.

The phosphorus-based extreme pressure agents shown in Table 3 are abbreviated as follows:

TABLE 3

| | Composition | | | |
|---|---|---|---|---|
| | base oil | cyclic organic phosphorus compound*4 | metal salt of carboxylic acid (% by weight) | phosphorus-based extreme pressure agent (% by weight) |
| Example 7 | MO | 0.01 | — | TCP (1.0) |
| Example 8 | PVE-1 | 0.05 | — | TNP (1.0) |
| Example 9 | PVE-2 | 0.01 | K oleate (0.5) | TCP (1.0) |
| Example 10 | PAG-1 | 0.05 | K oleate (1.0) | TCP (1.0) |
| Example 11 | PAG-2 | 0.02 | K sebacate (0.5) | DOHP (1.0) |
| Example 12 | POE-2 | 0.05 | — | TCP (1.0) |
| Example 13 | PC-1 | 0.05 | — | TCP (1.0) |
| Comparative Example 13 | MO | — | — | TCP (1.0) |
| Comparative Example 14 | PVE-1 | — | — | TNP (1.0) |
| Comparative Example 15 | PVE-2 | — | K oleate (0.5) | TCP (1.0) |
| Comparative Example 16 | PAG-1 | — | K oleate (1.0) | TCP (1.0) |
| Comparative Example 17 | PAG-2 | — | K sebacate (0.5) | DOHP (1.0) |
| Comparative Example 18 | POE-2 | — | — | TCP (1.0) |
| Comparative Example 19 | PC-1 | — | — | TCP (1.0) |

*4 The same compound as that in Table 2

TABLE 4

| | | Test of stability | | | | Amount of | Load of |
|---|---|---|---|---|---|---|---|
| | Refrigerant | appearance of oil | precipitates | metal catalyst | total acid value (mg KOH/g) | wear of pin in test of wear resistance (mg) | seizure in test of seizure resistance (N) |
| Example 7 | R22 | good | none | no change | 0.02 | 2.0 | 4270 |
| Example 8 | R407c | good | none | no change | 0.01 | 2.2 | 4120 |
| Example 9 | R410A | good | none | no change | 0.05 | 2.6 | 3980 |
| Example 10 | R134a | good | none | no change | 0.06 | 2.0 | 4900 |
| Example 11 | R407c | good | none | no change | 0.06 | 1.8 | 5680 |
| Example 12 | R410A | good | none | no change | 0.06 | 2.0 | 5170 |
| Example 13 | R410A | good | none | no change | 0.07 | 2.2 | 5030 |
| Comparative Example 13 | R22 | good | none | no change | 0.01 | 6.7 | 3060 |
| Comparative Example 14 | R407c | good | none | no change | 0.01 | 11.7 | 3270 |

TABLE 4-continued

| | Refrigerant | Test of stability: appearance of oil | precipitates | metal catalyst | total acid value (mg KOH/g) | Amount of wear of pin in test of wear resistance (mg) | Load of seizure in test of seizure resistance (N) |
|---|---|---|---|---|---|---|---|
| Comparative Example 15 | R410A | good | none | no change | 0.06 | 12.5 | 3140 |
| Comparative Example 16 | R134A | good | none | no change | 0.06 | 10.4 | 4280 |
| Comparative Example 17 | R407c | good | none | no change | 0.06 | 9.2 | 4420 |
| Comparative Example 18 | R410A | good | none | no change | 0.03 | 75.3 | 4530 |
| Comparative Example 19 | R410A | good | none | no change | 0.04 | 25.6 | 4250 |

INDUSTRIAL APPLICABILITY

The lubricating oil composition of the present invention which comprises the cyclic organic phosphorus compound exhibits excellent seizure resistance and wear resistance and is advantageously used as various types of lubricating oils such as bearing oil, gear oil, hydraulic oil and refrigerator oil. In particular, when the lubricating oil composition is used as the refrigerator oil for refrigerating apparatuses and air conditioning apparatuses such as automobile air conditioners, refrigerators, refrigerating storage apparatuses, air conditioners and heat pumps, the seizure resistance and the wear resistance in the presence of refrigerants such as compounds containing fluorine, ammonia, carbon dioxide, ethers and hydrocarbons are remarkably improved and the stability is maintained.

What is claimed is:

1. A lubricating oil composition which comprises a base oil and at least one compound selected from cyclic organic phosphorus compounds represented by the following general formula (I):

(I)

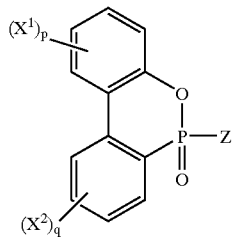

wherein Z represents (1) hydrogen atom, (2) an alkyl group, (3) a cycloalkyl group which may be substituted with alkyl groups having 1 to 12 carbon atoms and/or hydroxyl group, (4) an aryl group which may be substituted with alkyl groups having 1 to 12 carbon atoms and/or hydroxyl group or (5) an alkyl group substituted with an aryl group, which aryl group may be substituted with at least one of alkyl groups having 1 to 12 carbon atoms and hydroxyl group, $X^1$ and $X^2$ each independently represent a halogen atom or hydroxyl group and p and q each represent an integer 0 to 3, wherein the base oil is at least one oil selected from the group consisting of:

purified mineral oils.

alkylbenzenes, poly-α-olefins, polyvinyl ethers, polycarbonates, polyoxyalkylene glycols represented by general formula (V):

$$R^1—[(OR^2)_m—OR^3]_n \quad (V)$$

wherein $R^1$ represents hydrogen atom, an alkyl group having 1 to 10 carbon atoms, an acyl group having 2 to 10 carbon atoms or an aliphatic hydrocarbon group having 1 to 10 carbon atoms and 2 to 6 bonding portions; $R^2$ represents an alkylene group having 2 to 4 carbon atoms; represents hydrogen atom, an alkyl group having 1 to 10 carbon atoms or an acyl group having 2 to 10 carbon atoms; n represents an integer of 1 to 6; and m represent numbers giving an average value of numbers represented by m×n in a range of 6 to 80, polyoxyalkylene glycol derivatives having at least one constituting unit represented by general formula (VI):

(VI)

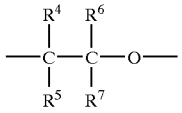

wherein $R^4$ to $R^7$ each represent hydrogen atom, a hydrocarbon group having 1 to 10 carbon atoms or a group represented by general formula (VII):

(VII)

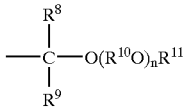

and at least one of $R^4$ to $R^7$ represents a group represented by general formula (VII), and wherein $R^8$ and $R^9$ each represent hydrogen atom, a monovalent hydrocarbon group having 1 to 10 carbon atoms or an alkoxyalkyl group having 2 to 20 carbon atoms. $R^{10}$ represents an alkylene group having 2 to 5 carbon atoms, a substituted alkylene group having alkyl groups as the substituents and 2 to 5 carbon atoms in the entire group or a substituted alkylene group having alkoxyalkyl groups as the substituents and 4 to 10 carbon atoms in the entire group, n represents an integer of 0 to 20 and $R^{11}$ represents a monovalent hydrocarbon group having 1 to 10 carbon atoms, esters of polybasic carboxylic acids, diesters obtained by esterification of addition products of alkylene oxides to monohydric alcohols with aliphatic dicarboxylic acids, esters obtained by esterification of addition products of 1 to 10 moles of alkylene oxides to polyhydric alcohols, ester oligomers of fumaric acid, esters of hydroxypivalic acid, and esters of aliphatic polyhydric alcohols and linear or branched fatty acids, said aliphatic polyhydric alcohols being at least one selected from the group consisting of ethylene glycol, propylene glycol, butylene glycol, neopentyl glycol, trimethylolethane, ditrimethylolethane, ditrimethylolpropane, glycerol, pentaerythritol, dipentaerythritol, tripentaerythritol and sorbitol.

2. A lubricating oil composition according to claim 1, wherein the cyclic organic phosphorus compound is a compound expressed by the following formula (II):

(II)

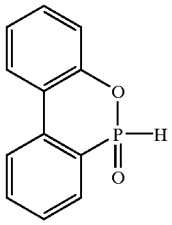

a compound expressed by the following formula (III):

(III)

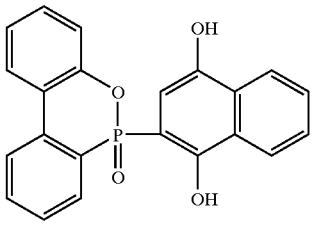

or a compound expressed by the following formula (IV):

(IV)

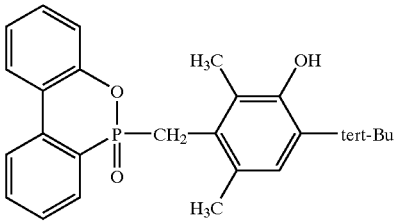

wherein tert-Bu represents a tertiary-butyl group.

3. A lubricating oil composition according to claim 1, wherein a content of the cyclic organic phosphorus compound is 0.001 to 5% by weight based on an amount of the composition.

4. A lubricating oil composition according to claim 1, which further comprises metal salts of carboxylic acids and/or phosphorus-based extreme pressure agents in an amount of 0.001 to 5% by weight based on an amount of the composition.

5. A lubricating oil composition according to claim 1, which further comprises at least one phenolic antioxidant.

6. A lubricating oil composition according to claim 1, which further comprises at least one acid catcher.

7. A refrigerator comprising a refrigerator oil and a refrigerant, wherein the refrigerator oil is a lubricating oil composition which comprises a base oil and at least one compound selected from cyclic organic phosphorus compounds represented by the following general formula (I):

(I)

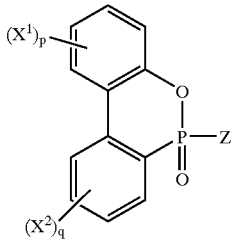

wherein Z represents (1) hydrogen atom, (2) an alkyl group, (3) a cycloalkyl group which may be substituted with alkyl groups having 1 to 12 carbon atoms and/or hydroxyl group, (4) an aryl group which may be substituted with alkyl groups having 1 to 12 carbon atoms and/or hydroxyl group or (5) an alkyl group substituted with an aryl group, which aryl group may be substituted with at least one of alkyl groups having 1 to 12 carbon atoms and hydroxyl group, $X^1$ and $X^2$ each independently represent a halogen atom or hydroxyl group and p and q each represent an integer 0 to 3.

8. A refrigerator according to claim 7, wherein cyclic organic phosphorus compound is a compound expressed by the following formula (II):

(II)

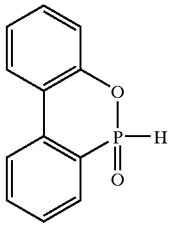

a compound expressed by the following formula (III):

(III)

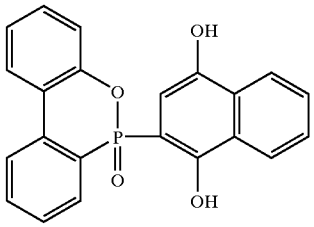

or a compound expressed by the following formula (IV):

(IV)

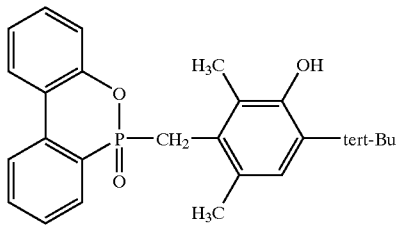

wherein tert-Bu represents a tertiary-butyl group.

9. The refrigerator according to claim 7, which is a compression-type refrigerator, wherein the refrigerant is carbon dioxide, ammonia, an ether, a hydrocarbon, or a fluorine-containing refrigerant.

10. The refrigerator according to claim 8, which is a compression-type refrigerator, wherein the refrigerant is carbon dioxide, ammonia, an ether, a hydrocarbon, or a fluorine-containing refrigerant.

11. A method of lubricating at least one of a gear, a bearing and a hydraulic system comprising applying thereto the lubricating oil according to claim 1.

12. A method of lubricating at least one of a gear, a bearing and a hydraulic system comprising applying thereto the lubricating oil according to claim 2.

13. A method of lubricating a refrigerator comprising applying thereto the a lubricating oil which comprises a base oil and at least one compound selected from cyclic organic phosphorus compounds represented by the following general formula (I):

(I)

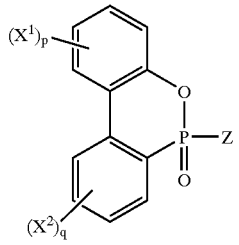

wherein Z represents (1) hydrogen atom, (2) an alkyl group, (3) a cycloalkyl group which may be substituted with alkyl groups having 1 to 12 carbon atoms and/or hydroxyl group, (4) an aryl group which may be substituted with alkyl groups having 1 to 12 carbon atoms and/or hydroxyl group or (5) an alkyl group substituted with an aryl group, which aryl group, may be substituted with at least one of alkyl groups having 1 to 12 carbon atoms and hydroxyl group, $X^1$ and $X^2$ each independently represent a halogen atom or hydroxyl group and p and q each represent an integer 0 to 3.

14. The method according to claim 13, wherein the refrigerator is a compression-type refrigerator which contains a refrigerant, which refrigerant is carbon dioxide, ammonia, an ether, a hydrocarbon, or a fluorine-containing refrigerant.

* * * * *